US010260275B2

(12) United States Patent
Rylander

(10) Patent No.: US 10,260,275 B2
(45) Date of Patent: Apr. 16, 2019

(54) ARRANGEMENT AND A METHOD TO MOUNT DOOR OR WINDOW FRAMES IN A WALL OPENING BY AID OF A FASTENING MEANS

(71) Applicants: Lars Eriksson, Emmaboda (SE); Tommy Rylander, Färjestaden (SE)

(72) Inventor: Tommy Rylander, Färjestaden (SE)

(73) Assignee: Lars Eriksson, Emmaboda (SE)

( * ) Notice: Subject to any disclaimer, the term of this patent is extended or adjusted under 35 U.S.C. 154(b) by 0 days.

(21) Appl. No.: 15/569,489

(22) PCT Filed: Apr. 27, 2016

(86) PCT No.: PCT/SE2016/000020
§ 371 (c)(1),
(2) Date: Oct. 26, 2017

(87) PCT Pub. No.: WO2016/175691
PCT Pub. Date: Nov. 3, 2016

(65) Prior Publication Data

US 2018/0298672 A1 Oct. 18, 2018

(30) Foreign Application Priority Data

Apr. 28, 2015 (SE) ..... 1500208

(51) Int. Cl.
*E06B 1/04* (2006.01)
*E06B 1/60* (2006.01)
*E06B 1/70* (2006.01)

(52) U.S. Cl.
CPC ..... *E06B 1/6053* (2013.01); *E06B 1/70* (2013.01)

(58) Field of Classification Search
CPC .... E06B 1/6053; E06B 1/6046; E06B 1/6069; E06B 1/70; E06B 3/50
See application file for complete search history.

(56) References Cited

U.S. PATENT DOCUMENTS 1,827,810 A 10/1931 Cooper
3,061,896 A * 11/1962 Wahlfeld ..... E06B 1/70 49/469

(Continued)

FOREIGN PATENT DOCUMENTS

WO WO 87/01412 A1 3/1987
WO WO 2014/189426 A1 11/2014

*Primary Examiner* — Brian D Mattei
(74) *Attorney, Agent, or Firm* — Blank Rome LLP

(57) ABSTRACT

The present invention relates to a fastening means (1) for mounting doors or windows, which comprises frames (2) intended to be mounted in a mounting direction (26) in an opening (3) in a wall, a floor, a ceiling, said fastening means (1) comprises a bracket (5) intended to be mounted on the backside (8) of the frame (2) and at least one screw or bolt (9), intended to be screwed into the end portion (4) of the opening (3), said bracket (5) comprises at least one locking slot (6), said screw or bolt (9) comprises at least one locking projection (11) intended to be pushed into said locking groove (6) for fastening the frame (2). Said locking slot (6) consists of a groove (12) for example an U-formed groove, extending mainly in the longitudinal direction (22) of the frame (2), said locking projection (11) comprises the head (10) of the screw or bolt (9) or a head (10), which is covered by a casing (14) e.g. a housing, which at least in some part encloses the head (10), which presses the first wall (7) of the groove (12) downwards during the mounting, said wall (7) comprises at least of a re-springed backwards projection (21), which is resilient backwards in order to form said groove (12), said locking comprises at least some part of the head (10) of the screw or bolt (9), which is locked in said groove (12) between the first wall (7) and another wall (15), which stops the moving forward of the head (10) during mounting.

7 Claims, 1 Drawing Sheet

(56) References Cited

U.S. PATENT DOCUMENTS

Figure 1:
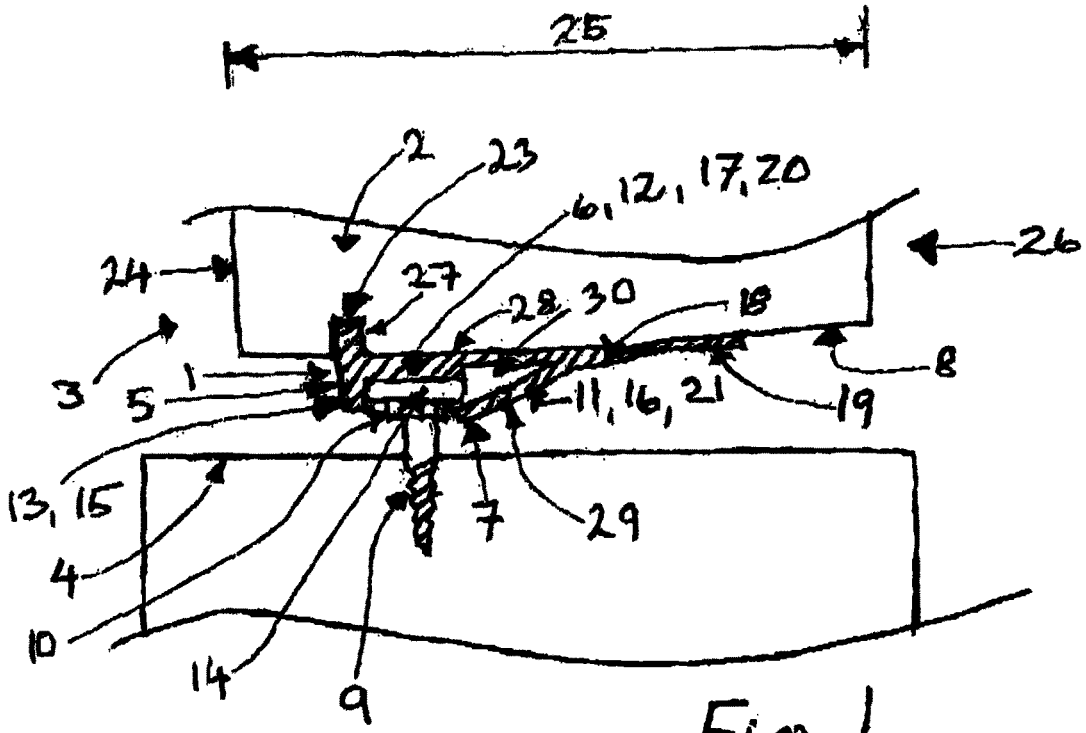

| | | | | |
|---|---|---|---|---|
| 4,028,849 | A * | 6/1977 | Anderson | E06B 1/6053 49/181 |
| 4,679,366 | A | 7/1987 | Hitchins | |
| 4,856,241 | A * | 8/1989 | Eriksson | E06B 1/603 52/217 |
| 2005/0232724 | A1* | 10/2005 | Selle | E06B 1/70 411/546 |
| 2017/0051552 | A1* | 2/2017 | Rosende | E06B 1/6053 |

* cited by examiner

ARRANGEMENT AND A METHOD TO MOUNT DOOR OR WINDOW FRAMES IN A WALL OPENING BY AID OF A FASTENING MEANS

The present invention refers to an arrangement and a method to mount doors—or window frames in wall openings by aid of fastening means. Said fastening means comprises a bracket having a locking slot. A number of brackets are mounted on the backside of the frame. The opening has an end section, where a number of screws or bolts are screwed in, where locking projections are provided to extend into said locking slot, which fasten the frame in the locking slot when the frame is mounted.

Today frame screws and spacers are used for mounting windows and doors in openings. This means that the number of openings must be made in the frames, where the frame screws shall be arranged in order to secure the frame in an end section of the frame. Before this has been done the opening in the bottom has to be built up by aid of spacers. Then the frame screws are fixed so that the frame side parts and the frame upper parts are arranged horizontally and vertically. The openings for those frame screws are very expensive to arrange and damages the frame, which can result in weakening, water leakage and root in frames made of wood. A method to solve this problem is described in the Swedish patent application 8504172-1 and the patent publication SE 537 222 C2. Here the openings in the frame are omitted and the use of spacers, but its locking projections become very easily oblique, so that a hook portion in the locking slot does not function to grab. Furthermore it is difficult for the end of the locking projection at all to meet the opening of the locking slot during mounting, since the opening to the locking slot is too narrow. This also happens owing to that the locking slot is not fastened and adjusted carefully in position below the head of the supporting bolt at the opening into said locking slot, but is adjusted easily wrong in a direction downwardly from the head towards the end section, because an existing locking washer according to this solution doesn't function well.

The object of the present invention is to solve the drawbacks existing in the above mentioned structures in providing the opening of the locking slot in a direction from the backside of the frame on a thicker part of the bracket, so that the end of the locking slot during mounting first is spring-back towards the thicker part in a direction towards the backside of the frame in order to, when it is in right position, automatically be guided correct by aid of a stop in the thicker part to spring-down into the locking slot.

Thanks to the invention a fastening means has been provided which is very simple in it's structure and is easy to mount with a very good function, where the locking projection automatically being locked up in a groove, for fixing the frame in said opening. Thanks to that the bracket has a re-springed projection only one bracket need to be manufactured. According to the invention the locking slot comprises of a groove in the form of for example an U-formed groove, which extends in the longitudinal direction of the frame, which is about 5-20 mm width and having the same depth. The locking projection comprises a head of said screw or bolt, which during mounting is pressing the first wall of the groove downwards, which serves as a re-springed projection, which the head first contacts during the mounting of the frame, in order to be able to press down the re-springed projection. The head passes the first projection which in this case spring backwards in order to form said groove, which comprises at least a part of said head, which in this case is locked fastened in the groove. During mounting of said frame in a step one a number of brackets are provided on the backsides of the frame. The brackets are turned so that they are placed in a distance from each other within the width of the frame having the locking groove pointing in the longitudinal direction of the frame, in which a position-fixing projection is grabbed in a guiding slot, rounding in a longitudinal direction. Screws or bolts are screwed into the end portion in places, which corresponds the position of the side surface where the high position of the head over the end portion is put in the right position with for example a water pass, so that it is in a vertical and horizontal direction in a distance from each other in a longitudinal direction having the heads contacting the plane portion in a second step. The heads are pressed past there-pringed projections in a third step, when the frame is pressed into the opening for securing into the locking slots in said groove, when the projections resilient backwards are springed-back and form the groove contacting said supporting surfaces.

Figure 2:
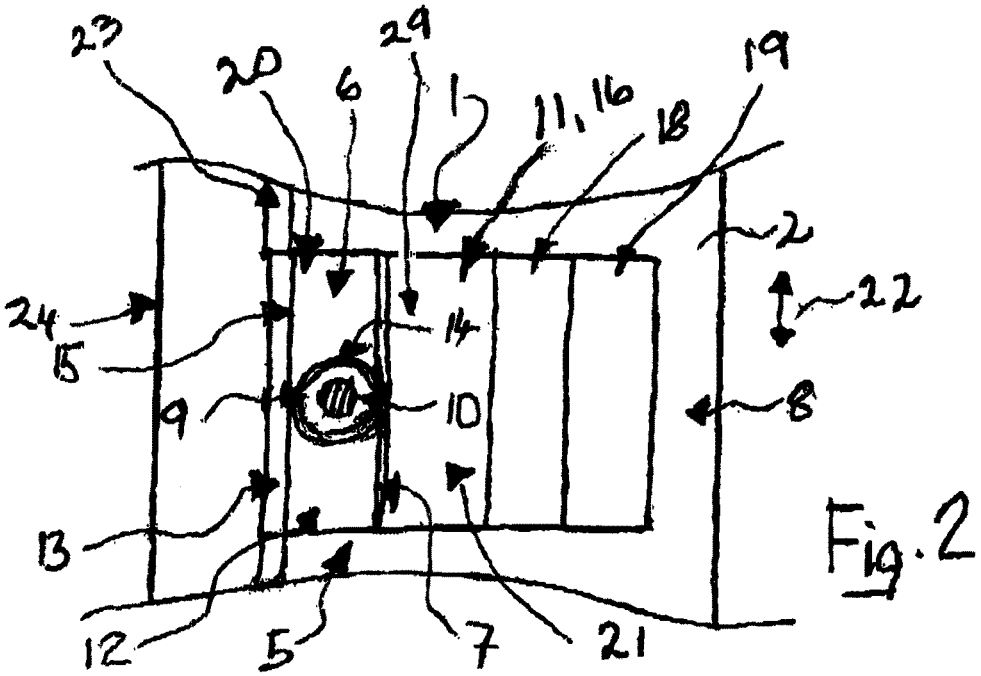

The invention is described closer below by aid of a preferred embodiment example in view of the drawings enclosed in which, FIG. 1 shows a vertical cross-section through a part of a lower most part of the frame across its longitudinal direction, which is fixed by the fastening means in an end portion of an opening in a wall, and FIG. 2 shows a bracket viewed from above towards the locking slot provided on the backside of the frame.

As can be seen from FIG. 1 and FIG. 2, a fastening means 1 is illustrated for securing doors or windows having a frame 2 mounted in an opening 3 in a wall in a mounting direction 26, and also a floor, or a roof. Said fastening means 1 comprises a bracket 5 intended to be mounted on the backside 8 of the frame 2 and screw or a bolt 9, intended to be screwed into the end portion 4 of said opening 3. The bracket 5 comprises a locking slot 6. The screw or bolt 9 comprises a locking projection 11, intended to project into said locking slot 6 for fixing of the frame 2. The locking slot 6 comprises a groove 12, which is U-formed, extending in the longitudinal direction 22 of the frame 2. Said locking projection 11 comprises the head 10 of said screw or bolt 10, which during the mounting is pressing the first wall 7 of the groove 12 downwards, which constitutes a re-springed projection 21. The head 10 is passing the re-springed projection 21, which is resilient backwards and the groove 12 in this case comprises at least a part of said head 10, which is locked in said groove 12. The head 10 can be covered with a casing 14, for example a housing, which in some part is enclosing said head 10 in order to create a form, which is suitable to contact the inside of the first wall 7. The groove 12 comprises a second wall 15, called stop portion 13 which is as high or higher than the first wall 7, which stops the head 10. The stop portion 13 extends in parallel with said groove 12 in the longitudinal direction 22. The re-springed projection 21 is resilient backwards in that case in order to provide the locking of said head 10 between the stop portion 13 and the re-springed projection 21. The projection 21 resilient backwards consists of a sheet-shaped unit 16 for example a sheet of metal, which is bent upwards in a rounded form or in an upwards directed folding or around an imagined line, extending in said length direction 22 towards said head 10, forming the first wall 7 of the outermost edge of the sheet-formed unit 16, which during the mounting is resilient backwards in order to create said U-formed groove 12. The bracket 5 comprises a thicker portion 17, where the groove 12 is provided. The bottom of the groove 12 comprises a supporting surface 20 in order to support the upper side of the head 10 of the screw or the bolt 9. The supporting surface 20 is connected to the projection 21 resilient backwards when it is pushed in a direction downwards in order to contact an inclination 18, which runs downwards towards an even portion 19, which is a thinner part of the bracket 5, on which the upper side of the bolt 9, when starting said mounting slides inwards in the mounting direction towards the first wall 7 in order to slide into the groove 12 and be locked into that place. The bracket 5 comprises a position fixing projection 27, which points in a direction from the under side 28 of the bracket 5 in a direction into the frame 2 in a guiding groove 23 being in that place or in order to contact a frame side 24 in order to fix said bracket 5 in this position fixing into this position from being moved from said mounting direction 26 of the frame 2 into the opening 3. The re-springed projection 21 extends as long way as the U-formed groove 12 and is lying there in a raised position in a recess or an opening 30 in said bracket 5, when the head is fixed. The supporting surface 20 lies in this way in mainly the same height, when being totally pushed downwards, as the outside 29 of the first wall 7.

The invention claimed is:

1. A fastening means for mounting doors or windows, which comprises frames intended to be mounted in a mounting direction into an opening in a wall, a floor, a ceiling, said fastening means comprises a bracket intended to be mounted on the backside of the frame and at least one screw or bolt, intended to be screwed into the end portion of the opening, said bracket comprises at least one locking slot, said screw or bolt comprises at least one locking projection intended to be pushed into said locking slot for fixing of said frame into position, wherein said locking slot consists of a groove, extending mainly in the longitudinal direction of the frame, said locking projection comprises the head of the screw or bolt, which is covered by a casing, which at least in some part encloses the head, which presses the first wall of the groove downwards during the mounting, said wall comprises at least a re-springed projection, which is resilient backwards in order to form said groove, said locking comprises at least some part of the head of the screw or bolt, which is locked into said groove between the first wall and another wall, which stops the moving forwards of the head during mounting.

2. A fastening means according to claim 1, wherein the groove comprises said other wall, called a stop portion, which is at least as high as the first wall, which stops the moving forwards of the head during mounting and which extends in the longitudinal direction, said projection, after having re-springed backwards, provides said locking of the head between stop portion and the re-springed backwards projection.

3. A fastening means according to claim 1, wherein the re-springed backwards projection comprises at least one sheet of metal, which is folded in an imaginary line pointing in the longitudinal direction forming the first wall, of the outermost edge of the sheet-formed unit.

4. A fastening means according to claim 1, wherein the bracket comprises a thicker portion where the groove is provided, said bottom of the grove forms a supporting surface in order to support the upper side on the head of the screw or bolt, said supporting surface contacts directly or indirectly to the re-springed backwards projection folded downwards, which in turn is connected to an inclination, which is sloping downwards to a plane portion, which is a thinner portion of the bracket on which the head of the bolt is slidable provided to slide into the groove in the mounting direction during mounting.

5. A fastening means according to claim 1, wherein the bracket comprises at least one projection for fixing the same into a position, which points in a direction from the other side of the bracket in a direction into the frame in a guiding groove existing in that place or in order to contact a frame side in order to in that position be fixed into position from moving in a mounting direction of the frame into said opening.

6. A fastening means according to claim 1, wherein, in the case the re-springed backwards projection in a position pushed down, is lying in a recess or opening in the bracket at the same time as the supporting surface in that case is lying mainly in the same height as the outside of the first wall when the same is pushed down.

7. A method for mounting a fastening means according to claim 1, wherein, during a first step, a number of brackets are provided on the backsides of the frame, said brackets then are turned to be placed in a predetermined distance from each other within the width of the frame having the locking groove pointing in the longitudinal direction, in which state a position fixing projection grabs a guiding groove running in the longitudinal direction, whereupon screws or bolts are screwed into the end portion, in places, which corresponds to the position of the side surface, where the high position of the head over said end portion is determined by aid of a water pass, in being in a vertical or horizontal direction in a distance from each other in the longitudinal direction having the heads contacting the plane portion in a second step, said heads in a third step are pressed past the re-springed backwards projections, when the frame is pressed into the opening to be locked in a fixed position in the locking slots in the groove.

* * * * *